US009114856B2

(12) United States Patent
Hannan et al.

(10) Patent No.: US 9,114,856 B2
(45) Date of Patent: Aug. 25, 2015

(54) BOAT LIFT STEP ASSEMBLY

(71) Applicants: Brent Hannan, Maple Grove, MN (US); Don Snegosky, Maple Grove, MN (US)

(72) Inventors: Brent Hannan, Maple Grove, MN (US); Don Snegosky, Maple Grove, MN (US)

( * ) Notice: Subject to any disclaimer, the term of this patent is extended or adjusted under 35 U.S.C. 154(b) by 0 days.

(21) Appl. No.: 14/134,170

(22) Filed: Dec. 19, 2013

(65) Prior Publication Data

US 2014/0182971 A1 Jul. 3, 2014

Related U.S. Application Data

(60) Provisional application No. 61/747,697, filed on Dec. 31, 2012.

(51) Int. Cl.

| | |
|---|---|
| ***E06C 1/00*** | (2006.01) |
| ***B63B 27/14*** | (2006.01) |
| ***E06C 9/08*** | (2006.01) |

(52) U.S. Cl.

CPC ..... *B63B 27/14* (2013.01); *B63B 27/146* (2013.01); *E06C 1/00* (2013.01); *E06C 9/08* (2013.01)

(58) Field of Classification Search

CPC ..... E06C 9/04; E06C 9/06; E06C 9/08; E06C 1/00

USPC ..... 182/91, 92, 90; 114/362

See application file for complete search history.

(56) References Cited

U.S. PATENT DOCUMENTS

| | | | | |
|---|---|---|---|---|
| 5,896,946 | A * | 4/1999 | Brackett | 182/127 |
| 6,334,508 | B1 * | 1/2002 | Shields | 182/116 |
| 6,986,523 | B1 * | 1/2006 | Bickford | 280/414.1 |
| 7,100,740 | B2 * | 9/2006 | Newton | 182/206 |
| 8,322,739 | B1 * | 12/2012 | Fair et al. | 280/164.1 |
| 2005/0039983 | A1 * | 2/2005 | Tombarello | 182/93 |

* cited by examiner

*Primary Examiner* — Alvin Chin-Shue

(74) *Attorney, Agent, or Firm* — Geiser Law, PLLC; Greg N. Geiser

(57) ABSTRACT

A step assembly for attachment to a boat lift frame to allow for easy entry and exit from a boat secured on a boat lift. The assembly comprises a platform connected to a vertical member. The vertical member is fastened to a beam of the boat lift frame. The platform may be hingedly connected to the vertical member and movable between a horizontal position and a vertical position.

3 Claims, 3 Drawing Sheets

BOAT LIFT STEP ASSEMBLY

CROSS REFERENCE TO RELATED APPLICATIONS

This application claims the benefit of provisional patent application Ser. No. 61/747,697 filed 2012 Dec. 31 by the present inventors.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to an adjustable step assembly for attachment to a boat lift or as it sometimes called a lake lift for a boat.

BACKGROUND OF THE INVENTION

Often when a boat is moored to a dock or pier, a boat lift or as it sometimes called a lake lift is used. The lift allows the user to moor the boat up and out of the water. This type of mooring helps to maintain the boats finish, paint, mechanical components, and reduces the overall wear and tear on the boat.

There are two basic types of boat lift; a vertical lift and a cantilevered lift. Each of these type of lift operate according to the same basic principles and has a similar structure. Both lifts include a frame that is placed into the water adjacent to a pier or dock. Typically, this frame includes pilings that are placed on the seabed, lakebed, or riverbed that act as a base to support the lift. A movable bunk provides resting support to the boat. In a cantilevered style lift, the bunk is hingedly connected to the frame and raised into position above the water. In a vertical lift, the bunk is secured to a frame that is hoisted vertically out of the water.

Often, the frame structure of a boat lift is located adjacent to a dock or pier, allowing users an access point to a raised boat. Typically, due to various differences in the designs of boat lifts, environmental conditions, or movement during use, a user is required to step across a large gap between the pier or dock and the boat. Often this makes entry into a retained boat difficult for many users. Therefore, there is a need for a device that makes entry into a boat easier and more accommodating. Preferably, this device is universal and adaptable to several types and styles of lifts.

SUMMARY OF THE INVENTION

A step assembly for attachment to a boat lift is disclosed. The step assembly includes a platform affixed to a vertical member removably affixed to the boat lift frame. The platform provides a stepping surface in a gap between a dock or pier and a boat located on the boat lift to aid in the entry and exit of the boat. In an alternate embodiment, the platform is hingedly connected to the vertical member and movable between a raised position and a lowered position. In the raised position, the platform is orientated coplanar with the vertical member to allow for the boat to dock and undock without the risk of striking the platform. In the lowered position, the platform is orientated perpendicular to the vertical member and acts as a step to aid in the entry and exit from a boat retained within the lift.

BRIEF DESCRIPTION OF THE SEVERAL VIEWS OF THE DRAWING (S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
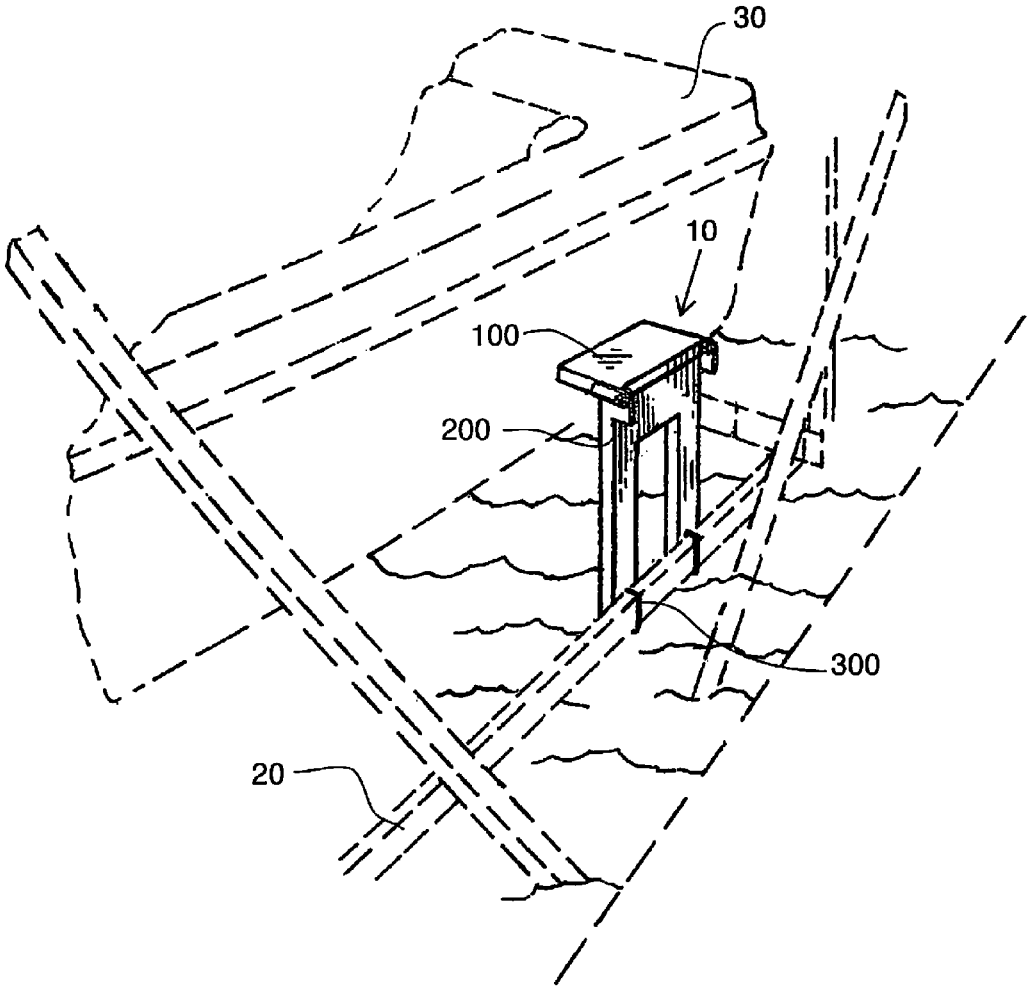
FIG. 1 is an isometric view of the device in use, according to the present invention.

Referring now to FIG. 1-4, various views of a step assembly for attachment to a boat lift for a boat 30, the step assembly is generally referred to as 10. The step assembly 10 includes a platform 100 affixed to a vertical member 200 and a fastener 300. The step assembly 10 is attached to a boat lift frame 20 using the fastener 300 and is designed to provide support to aide in the entry and exit and of the boat.

The platform 100 is a substantially planar surface and defined by a front side 101, rear side 102, left side 103, and right side 104. The front side 101 is opposite the rear side 102. The left side 103 is opposite the right side 104 and in communication with the front side 101 and rear side 102. The right side 104 is opposite the left side 103 and in communication with the front side 101 and rear side 104. Wherein, the front side 101, rear side 102, left side 103, and right side 104 define the periphery of the planar surface of the platform 100. Preferably, the platform has a thickness to support and bear the weight of a user.

The vertical member 200 extends perpendicular from the frame 20 opposite the water. The vertical member 200 includes a plurality of through holes 201 extending along its length and has an upper end 202 and lower end 203 opposite the upper end 202. The through holes 201 are designed to receive the fastener 300 and allow for multiple height adjustments of the device in use. To change the height of the device, the fastener 300 is placed into the through holes 201 at a location for the desired height.

The fastener 300 secures the vertical member 200 to the frame 20 by being received in the through holes 201. Preferably, the fastener 300 is a U-bolt with threaded ends sized to the height of the frame 20, wherein the U-bolt fastener 300 is placed around the frame 20 with each end of the U-bolt received in a corresponding through hole 201 and extending through the width of the vertical member 200 where it is retained using washers and a lock nut.

According to this configuration, utilizing a different sized fastener 300 can accommodate different frames sizes. Further, the plurality of through holes 201 allow the height of the platform 100 to be adjusted to varying sizes of boats 30 and frames 20.

Figure 2:
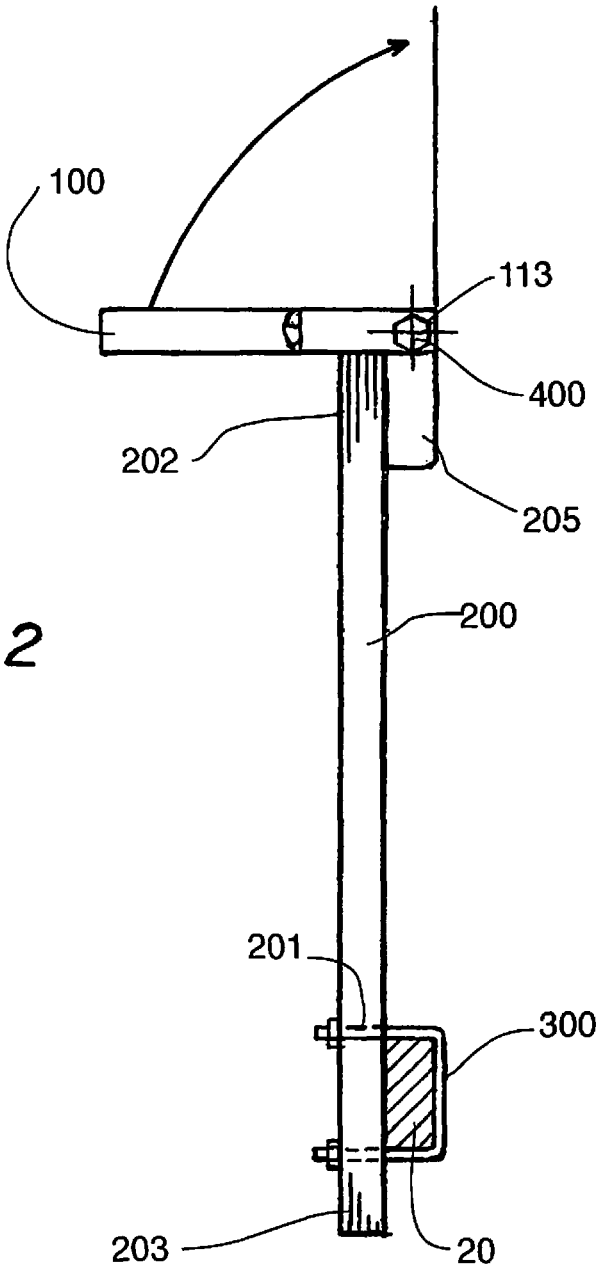
FIG. 2 is a side view of the device, according to the present invention.
Figure 3:
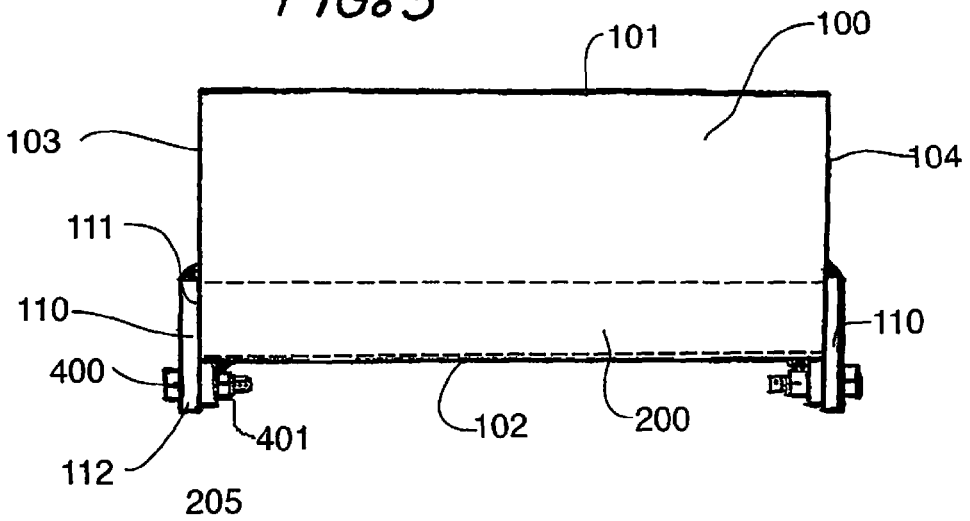
FIG. 3 is a top view of the device, according to the present invention.
Figure 4:
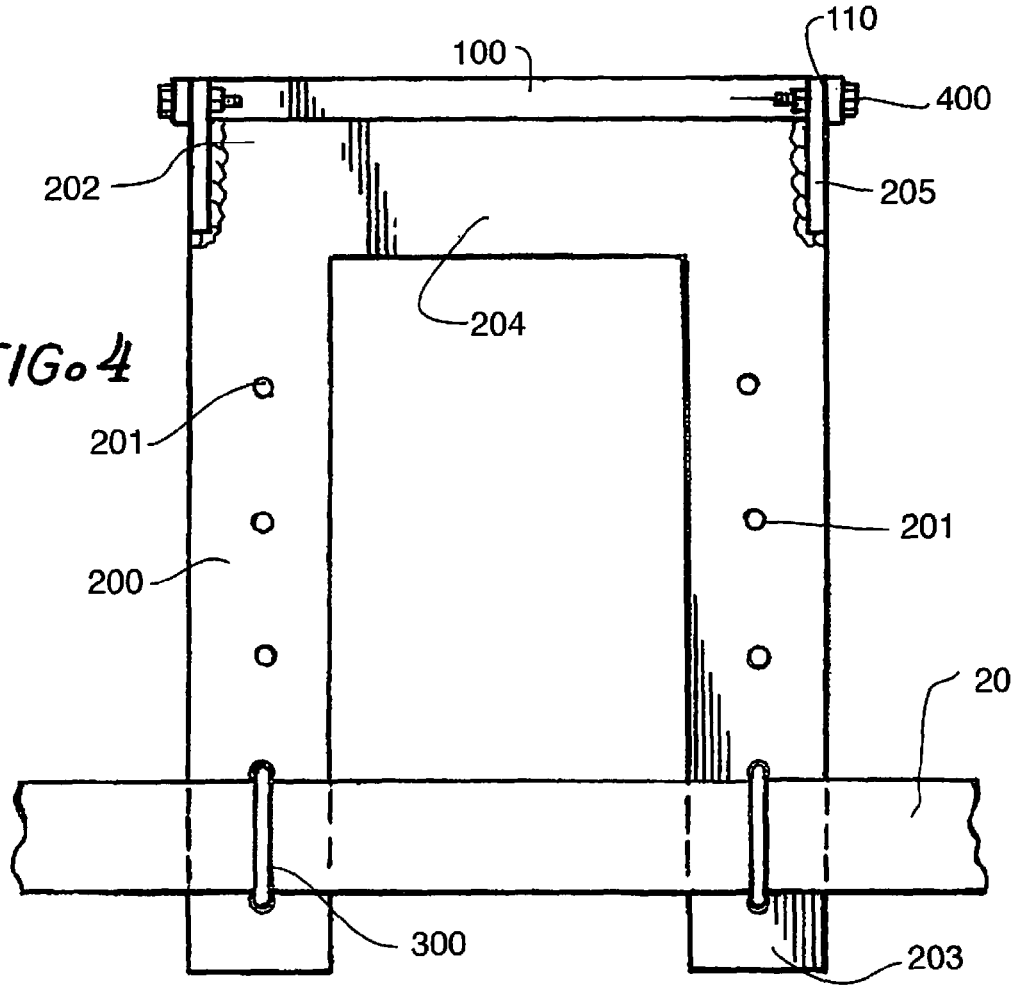
FIG. 4 is a front view of the device, according to the present invention.

In an alternate embodiment, the platform 100 is hingedly connected to the vertical member and movable between a raised position and a lowered position, as indicated by the arrow in FIG. 2. To facilitate movement, the platform 100 includes a pair of hinge plates 110. The hinge plates 110 are affixed to both the left side 103 and right side 104 adjacent to the rear side 102. The hinge plates have an attached end 111 and a free end 112. The free end 112 extending beyond the periphery of the platform and having an aperture (not pictured).

Preferably, the vertical member 200 is comprised of a pair of legs forming a pair of vertical members 200 connected with a brace 204. The upper end 202 includes a second hinge plate 205. The second hinge plate 205 affixed to the vertical member 200 and having an aperture (not pictured) aligned with the aperture of the first hinge plates 110 when the platform 100 is rested on the upper end 202 of the vertical member 200.

In the preferred embodiment of the present invention, the second hinge plate 205 extends outward from the vertical member 200 opposite the boat 30. According to this configuration, the platform 100 will rest on the vertical member 200 in a lowered position perpendicular to a length of the vertical support member.

A hinge pin 400 is received in the aligned apertures of the first hinge plates 110 and second hinge plate 205 and retained within the apertures using a retaining means 401. The hinge pin 400 ensures that the platform 100 and vertical member 200 are in proper alignment and connects the platform 100 to the vertical member 200. Preferably the hinge pin 400 is comprised of a threaded bolt and the retaining means 401 is a nut, although other similar materials and configurations may be used, such as a rod retained with a cotter pin or split pin.

In the hinged configuration, the raised position of the platform 100 extends parallel and coplanar to the vertical member 200 in an unobstructed position. This allows for maximum clearance when docking the boat 30. In the lowered position, the platform 100 extends perpendicular to the vertical member 200 allowing users to easily enter and exit the boat 30.

Preferably, the device 10 is constructed out of aluminum due to its corrosion resistance and weight properties, although other similar materials may be used. Preferably these materials are resistant to corrosion. It is further preferred that the platform 100 include an anti-slip surface. This anti-slip surface may be ribs in the surface of the platform 100 or an additional material added to the surface of the platform 100 to prevent slipping, such as a rubber, or sand paper like material.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A step assembly for attachment to a boat lift, the step assembly comprising:

a platform, the platform having:

a top side;

a bottom side, the bottom side opposite the top side, the distance between the top side and the bottom side defining a thickness;

a front side;

a rear side, the rear side opposite of the front side;

a left side, the left side in communication with the front side and the rear side;

a right side, the right side opposite the left side and in communication with the front side and the rear side, wherein the front side, rear side, left side, and right side define a perimeter of the platform; and a vertical support member, the vertical support member having:

an upper end, the upper end adjacent the bottom side of the platform and extending a width, the width corresponding to the distance between the right side of the platform and the left side of the platform, the upper end providing resting support for the platform, and a pair of support legs, each of the support legs affixed to the upper end, and each support leg having a plurality of through holes along a length of each of the support legs, the through holes sized to receive a fastener; and the fastener extending through the through hole and securing the vertical support member to a boat lift, wherein the platform is hingedly connected to the vertical support member and movable to a first position perpendicular to the vertical support member and resting on the upper end and a second position coplanar with and opposite the vertical support member; a left hinge plate, the left hinge plate affixed to the left side adjacent to the rear side, the left hinge plate having an attached end and a free end, the free end extending beyond the rear side opposite the front side and having an aperture; a fight hinge plate, the right hinge plate affixed to the right side, the right hinge plate having an attached end and a free end, the free end extending beyond the rear side opposite the front side and having an aperture; a left vertical hinge plate, the left vertical hinge plate located on the vertical support member adjacent to the left hinge plate, the left vertical hinge plate having an aperture, the aperture aligned with the aperture of the left hinge plate; a right vertical hinge plate, the right vertical hinge plate located on the vertical support member adjacent to the right hinge plate, the right vertical hinge plate having an aperture, the aperture aligned with the aperture of the right hinge plate; and a pair of hinge pins, the hinge pins each received in the co-operating apertures of the left hinge plate and left vertical hinge plate and the right hinge plate and the right vertical hinge plate, wherein the hinge pins each allow for hinged movement of the platform from a horizontal position resting on the upper end to a vertical position opposite the vertical support member and coplanar with the vertical support member.

2. The device as in claim 1, wherein the top side has an anti-slip surface.

3. A step assembly for attachment to a boat lift, the step assembly comprising:

a platform, the platform having:

a top side, the top side having an anti-slip surface;

a bottom side, the bottom side opposite the top side, the distance between the top side and the bottom side defining a thickness;

a front side;

a rear side, the rear side opposite of the front side;

a left side, the left side in communication with the front side and the rear side;

a left hinge plate, the left hinge plate affixed to the left side adjacent to the rear side, the left hinge plate having an attached end and a free end, the free end extending beyond the rear side opposite the front side and having an aperture a right side, the right side opposite the left side and in communication with the front side and the rear side, wherein the front side, rear side, left side, and right side define a perimeter of the platform;

a right hinge plate, the right hinge plate affixed to the right side, the right hinge plate having an attached end and a free end, the free end extending beyond the rear side opposite the front side and having an aperture; and a vertical support member, the vertical support member having:

an upper end, the upper end adjacent the bottom side of the platform and extending a width, the width corresponding to the distance between the right side of the platform and the left side of the platform the upper end providing resting support for the platform, and a pair of support legs, each of the support legs affixed to the upper end, and each support leg having a plurality of through holes along a length of each of the support legs, the through holes sized to receive a fastener, the vertical support member having:

a left vertical hinge plate, the left vertical hinge plate located on the vertical support member adjacent to the left hinge plate, the left vertical hinge plate having an aperture, the aperture aligned with the aperture of the left hinge plate;

a right vertical hinge plate, the right vertical hinge plate located on the vertical support member adjacent to the right hinge plate, the right vertical hinge plate having an aperture, the aperture aligned with the aperture of the right hinge plate; and a pair of hinge pins, the hinge pins each received in the co-operating apertures of the left hinge plate and left vertical hinge plate and the right hinge plate and the right vertical hinge plate, wherein the hinge pins each allow for hinged movement of the platform from a horizontal position resting on the upper end to a vertical position opposite the vertical support member and coplanar with the vertical support member; and the fastener extending through the through hole and securing the vertical support member to a boat lift.

* * * * *